US008157248B2

(12) United States Patent
Suzuki et al.

(10) Patent No.: US 8,157,248 B2
(45) Date of Patent: Apr. 17, 2012

(54) CARBONATE SPRING PRODUCING SYSTEM

(75) Inventors: Satoshi Suzuki, Toyohashi (JP); Ken Ooyachi, Otake (JP); Hiroki Sakakibara, Tokyo (JP); Masaaki Satou, Nagoya (JP); Masanori Itakura, Tokyo (JP); Hiroshi Tasaka, Toyohashi (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 12/977,504

(22) Filed: Dec. 23, 2010

(65) Prior Publication Data

US 2011/0123402 A1 May 26, 2011

Related U.S. Application Data

(62) Division of application No. 10/586,162, filed as application No. PCT/JP2005/000194 on Jan. 11, 2005, now abandoned.

(30) Foreign Application Priority Data

Jan. 14, 2004 (JP) ..... 2004-007008
Jun. 29, 2004 (JP) ..... 2004-191016

(51) Int. Cl.
*B01F 3/04* (2006.01)

(52) U.S. Cl. ..... 261/26; 261/29; 261/64.3; 261/DIG. 7

(58) Field of Classification Search ..... 261/26, 261/29, 36.1, 53, 64.3, DIG. 7
See application file for complete search history.

(56) References Cited

U.S. PATENT DOCUMENTS

| | | | | |
|---|---|---|---|---|
| 4,083,225 | A | 4/1978 | Day et al. | |
| 5,288,311 | A | 2/1994 | Furutani et al. | |
| 5,347,665 | A | 9/1994 | Kumon et al. | |
| 5,356,533 | A | 10/1994 | Nakagawa | |
| 6,821,481 | B1 * | 11/2004 | Osajima et al. | 422/28 |
| 7,237,767 | B2 * | 7/2007 | Sakakibara et al. | 261/36.1 |
| 7,334,780 | B2 * | 2/2008 | Sakakibara et al. | 261/36.1 |
| 7,651,074 | B2 | 1/2010 | Ooyachi et al. | |
| 2009/0039534 | A1 | 2/2009 | Ooyachi et al. | |

FOREIGN PATENT DOCUMENTS

| | | | |
|---|---|---|---|
| JP | H05-584272 | A | 4/1993 |
| JP | H05-137985 | A | 6/1993 |
| JP | H07-114790 | B2 | 12/1995 |
| JP | H07-322392 | A | 12/1995 |

(Continued)

*Primary Examiner* — Charles Bushey

(74) *Attorney, Agent, or Firm* — Fitch, Even, Tabin & Flannery LLP

(57) ABSTRACT

A carbonate spring producing system includes a gas-liquid separator which is connected on the downstream side of a carbonic acid gas dissolver which connects to a carbonic acid gas supply means and hot water supply. A liquid lead-out pipe is connected to the gas-liquid separator. Preferably an un-dissolved carbonic acid gas lead-out pipe is connected on the upstream sides of the gas-liquid separator and the carbonic acid gas dissolver. The un-dissolved carbonic acid gas lead-out pipe includes a control valve, a compressor, and a liquid level detection means. The control valve controls a flow rate of un-dissolved carbonic acid gas from the gas-liquid separator. An amount of un-dissolved carbonic acid gas in the gas-liquid separator is monitored, so that the un-dissolved carbonic acid gas in the hot water can be separated and removed by the gas-liquid separator. The separated and removed un-dissolved carbonic acid gas can be re-dissolved.

11 Claims, 5 Drawing Sheets

FOREIGN PATENT DOCUMENTS

| | | | |
|---|---|---|---|
| JP | H11-192421 | A | 7/1999 |
| JP | 3168135 | B2 | 5/2001 |
| JP | 2001-170659 | A | 6/2001 |
| JP | 2003-66023 | A | 3/2003 |
| WO | WO 03/020405 | A1 | 3/2003 |

* cited by examiner

CARBONATE SPRING PRODUCING SYSTEM

CROSS REFERENCE TO RELATED APPLICATIONS

This application is a Divisional patent application of U.S. application Ser. No. 10/586,162, filed Oct. 30, 2006, now abandoned, which is the U.S. National Stage Patent Application of PCT International Application No. PCT/JP2005/000194 filed Jan. 11, 2005, which designated the U.S. and was not published under PCT Article 21(2) in English, and this application claims the priority from Japanese Application No. 2004-007008 filed Jan. 14, 2004, and Japanese Application No. 2004-191016, filed Jun. 29, 2004, the complete disclosures of each of the aforesaid applications are incorporated herein by reference.

TECHNICAL FIELD

The present invention relates to a carbonate spring producing system which enables un-dissolved carbonic acid gas to be redissolved while monitoring abnormal generation of the un-dissolved carbonic acid gas.

BACKGROUND ART

Because the carbonate springs have an excellent heat retaining effect, the carbonate springs is used in a bath house and the like in which a hot spring is utilized from a long time ago. Basically the heat retaining effect of the carbonate springs is considered as improvement of a body situation by an angiotelectasia effect of a contained carbonic acid gas. It is also considered that an increase and expansion of a capillary bed occur by intrusion of the carbonic acid gas into a skin to improve skin blood circulation. Therefore, it is regarded that the carbonate springs are effective in treating a regressive change and a peripheral circulatory disorder.

Recently, in the treatment of the regressive change and the peripheral circulatory disorder, it is found that a physiological effect of the carbonate springs can further remarkably be exerted when a carbon dioxide concentration in the carbonate springs becomes about 1200 mg/L (liter) which is a supersaturated concentration range in hot water having a temperature of about 40° C.

Examples of method of synthetically producing the carbonate springs include a carbonate spring producing method of circulating the hot water in the bath through a carbonic acid gas dissolver with a circulating pump in a circulation type carbonate spring producing system and a carbonate spring producing method of producing carbonate hot water by passing the hot water supplied from a water heater or the like through the carbonic acid gas dissolver once with one-pass type carbonate spring producing system. For example, a static mixer and a hollow fiber membrane module are often used as the carbonic acid gas dissolver having good dissolution efficiency.

However, even if such carbonic acid gas dissolvers are used, the carbonic acid gas cannot be dissolved in the hot water at the concentration of 100%. In this case, un-dissolved carbonic acid gas is wastefully emitted in the atmosphere, which generates a large problem from the viewpoint of running cost. The un-dissolved carbonic acid gas mixed in a bubble in the carbonate springs is emitted into a bath room, and the bath room is in the high concentration atmosphere of the carbonic acid gas in the case where a large amount of carbonate springs is produced like full immersion bath, which possibly has an adverse affect on a human body.

A threshold limit value (TLV) of the carbonic acid gas concentration is not more than 0.5% in a room. When the carbonic acid gas concentration becomes not lower than 10%, adjustment functions of the human body are disabled, and a person becomes unconscious in about ten minutes. When the carbonic acid gas concentration becomes not lower than 25%, it is said that respiration becomes slow and a person dies in several hours (for example, see Non-Patent Document 1).

For example, there is proposed a carbonate spring producing system, in which the un-dissolved carbonic acid gas separated by a gas separator is recovered by introducing the un-dissolved carbonic acid gas to a compressor and the recovered carbonic acid gas is introduced to the carbonic acid gas dissolver to dissolve the carbonic acid gas in the hot water (for example, see Patent Document 1).

In the carbonate spring producing system described in Patent Document 1, the un-dissolved carbonic acid gas separated by the gas separator is recovered with the compressor, and the recovered carbonic acid gas is sent to the carbonic acid gas dissolver again and utilized to produce the carbonate springs. The inventors have been proposed the carbonate spring producing system described in Patent Document 1.

A carbonic acid gas neutralization apparatus is proposed as an example in which the carbonic acid gas is dissolved in the liquid (for example, see Patent Document 2). In the carbonic acid gas neutralization apparatus described in Patent Document 2, the un-dissolved carbonic acid gas separated by gas-liquid separating means is injected in an upstream of a pump which sends the alkaline drain solution to mix the un-dissolved carbonic acid gas with the hot water, or the un-dissolved carbonic acid gas is mixed in the hot water such that an ejector in which the alkaline drain solution is utilized as a driving solution is used as a gas injection nozzle to suck the un-dissolved carbonic acid gas from the ejector.

Examples of a method of measuring the carbonic acid gas concentration in the carbonate springs includes a method in which an ion-electrode type carbonic acid gas concentration meter is used, a method of computing the concentration from a pH measurement value with a pH meter (for example, see Patent Document 3), and a method in which an amount of bubble existing in the carbonate springs is measured with an ultrasonic wave sensor to compute the concentration from the measured bubble amount (for example, see Patent Document 4). The inventors have been proposed the methods of measuring the carbonic acid gas concentration in the carbonate springs described in Patent Documents 3 and 4.

Patent Document 1: Japanese Patent Application Laid-Open No. H11-192421

Patent Document 2: Japanese Patent Application Laid-Open No. 2001-170659

Patent Document 3: Japanese Patent Application Laid-Open No. 2003-066023

Patent Document 4: International Patent Publication No. WO 2003/020405

Non-Patent Document 1: Security (Iwatani High-pressure Gas Security Information Journal, Vol. 63 (2003)

DISCLOSURE OF THE INVENTION

Problems to be Solved by the Invention

As described in FIG. 1 of Patent Document 1 and FIGS. 1 to 3 of Patent Document 2, in a structure of the gas-liquid separator, the un-dissolved carbonic acid gas and the liquid are separated such that the un-dissolved carbonic acid gas is located in an upper portion while the liquid is located in a lower portion of the gas-liquid separator. The un-dissolved carbonic acid gas is emitted outside the gas-liquid separator from the upper portion, and the liquid is sent onto a downstream side by a liquid lead-out pipe attached to the lower portion of the gas-liquid separator.

However, in the case where the supplied carbonic acid gas has the excessive flow rate, in the case where the supplied hot water has the low saturated concentration due to the high temperature of the supplied hot water, or in the case where the carbonic acid gas concentration of the supplied hot water is gradually increased to the high concentration like the circulation type carbonate spring producing system, the amount of un-dissolved carbonic acid gas emitted from the liquid sent to the gas-liquid separator is increased, and sometimes the amount of un-dissolved carbonic acid gas exceeds the ability to discharge the un-dissolved carbonic acid gas from the gas-liquid separator. At this point, the gas-liquid separator is filled with the un-dissolved carbonic acid gas to lower the liquid level of the gas-liquid separator. When the liquid level is lowered below the liquid lead-out pipe, the un-dissolved carbonic acid gas is released from the liquid lead-out pipe of the gas-liquid separator. In order to securely separate the gas and the liquid, it is necessary that the liquid level in the gas-liquid separator be maintained higher than the liquid lead-out pipe.

In the configuration of the carbonate spring producing system described in Patent Document 1, and in the configuration of the carbonic acid gas neutralization apparatus described in Patent Document 2, the gas-liquid separator does not include means for detecting the liquid level, and, as described above, there is a possibility that the un-dissolved carbonic acid gas which is mixed in the carbonate spring while formed in the bubble is emitted into the bath room based on the lowering of the liquid level of the gas-liquid separator.

In view of the foregoing, an object of the invention is to provide a carbonate spring producing system, in which the amount of un-dissolved carbonic acid gas in the gas-liquid separator is always monitored, the un-dissolved carbonic acid gas in the hot water is securely separated and removed by the gas-liquid separator, and the separated and removed un-dissolved carbonic acid gas can be redissolved.

Means of Solving the Problems

In order to achieve the object, a first aspect of the invention is a carbonate spring producing system which dissolves a carbonic acid gas in hot water to produce carbonate springs, the carbonate spring producing system characterized by including carbonic acid gas supply means; hot water supply means; a carbonic acid gas dissolver which is connected to the carbonic acid gas supply means and connected to the hot water supply means; a liquid lead-out pipe which is connected on a downstream side of the carbonic acid gas dissolver; a gas-liquid separator which is arranged in a way of the liquid lead-out pipe; and bubble detection means which detects a bubble amount of the carbonate springs. It is desirable that the hot water supply means have hot water circulating means for circulating the hot water in a bath.

Preferably the bubble detection means includes an ultrasonic transmitter; an ultrasonic receiver which receives an ultrasonic wave transmitted from the ultrasonic transmitter, the ultrasonic receiver being arranged across the liquid lead-out pipe from the ultrasonic transmitter; and a determination unit which computes ultrasonic intensity received with the ultrasonic receiver, the determination unit making the determination by comparing the ultrasonic intensity to a predetermined threshold, and, when the ultrasonic intensity is lower than the threshold, the determination unit determines that an anomaly exists in the liquid lead-out pipe, and the determination unit outputs an abnormal signal. It is desirable that the ultrasonic transmitter and the ultrasonic receiver be horizontally placed. Preferably the liquid lead-out pipe provided between the ultrasonic transmitter and the ultrasonic receiver is horizontally arranged.

Preferably the bubble detection means includes a liquid level sensor arranged inside the gas-liquid separator, and, when a liquid level in the gas-liquid separator is lower than a predetermined threshold, the bubble detection means determines that the anomaly exists in the liquid lead-out pipe, and the bubble detection means outputs the abnormal signal. The carbonic acid gas supply means has an electromagnetic valve, and the electromagnetic valve can be controlled to be closed by the abnormal signal from the bubble detection means. The carbonic acid gas supply means may have a flow rate control valve which performs control to keep a carbonic acid gas flow rate constant. The hot water supply means may have liquid sending means which performs controls to maintain a constant hot water flow rate supplied to the carbonic acid gas dissolver. A throttle which increases water pressure in the gas-liquid separator can also be arranged in the liquid lead-out pipe.

In order to achieve the object, a second aspect of the invention is a carbonate spring producing system which dissolves a carbonic acid gas in hot water to produce carbonate springs, the carbonate spring producing system characterized by including carbonic acid gas supply means; a control valve which controls a flow rate of the carbonic acid gas; hot water supply means; a carbonic acid gas dissolver which is connected to the carbonic acid gas supply means and connected to the hot water supply means; a gas-liquid separator which is connected on a downstream side of the carbonic acid gas dissolver; an un-dissolved carbonic acid gas lead-out pipe which is connected on an upstream side of the carbonic acid gas dissolver while connected to the gas-liquid separator; a liquid lead-out pipe which is connected to the gas-liquid separator; a control valve which controls a flow rate of un-dissolved carbonic acid gas from the gas-liquid separator; a compressor which is arranged in a way of the un-dissolved carbonic acid gas lead-out pipe; detection means for measuring a liquid level of the gas-liquid separator; and flow rate control means for controlling the flow rate of the supplied carbonic acid gas and the flow rate of the un-dissolved carbonic acid gas based on the liquid level of the gas-liquid separator.

A carbonate spring producing system of the invention further includes the flow rate control means for controlling the flow rate of the supplied carbonic acid gas and the flow rate of the supplied un-dissolved carbonic acid gas so as to raise the liquid level of the gas-liquid separator higher than the liquid lead-out pipe of the gas-liquid separator. A carbonate spring producing system of the invention may includes a gas emission pipe which is connected to the gas-liquid separator; and an emission control valve which is arranged in a way of the gas emission pipe. Instead of the gas flow rate control means, a carbonate spring producing system of the invention may include gas flow rate control means for measuring a rate at which the liquid level is lowered in the gas-liquid separator with a device, the gas flow rate control means computing a carbonic acid gas concentration of the sending hot water to control the flow rate of the supplied carbonic acid gas. A carbonate spring producing system of the invention may include piping which connects a discharge side and an inlet side of the compressor; and a control valve which is arranged in the way of the piping, the control valve opening and closing the piping. A carbonate spring producing system of the invention may further include concentration setting means for setting the desired carbonic acid gas concentration; and gas flow rate control means which controls the flow rate of the supplied carbonic acid gas such that the concentration of the sending hot water becomes equal to a value set by the concentration setting means.

EFFECTS OF THE INVENTION

The carbonate spring producing system of the invention has the main feature in which the bubble detection means is provided. The anomaly of the carbonate springs can be detected in the gas-liquid separator or the liquid lead-out pipe by including the bubble detection means. In the invention, the un-dissolved carbonic acid gas (bubble amount of carbonate spring) of the carbonate springs led out to the liquid lead-out pipe the from the gas-liquid separator can always be monitored, and the opening and closing of the carbonic acid gas supply line can be controlled based on the increase and decrease in bubble amount.

For example, an ultrasonic sensor, a photosensor, an ultraviolet ray sensor, a floating type level sensor, an electrostatic capacity type level sensor, and a pressure difference type level sensor can be used as the bubble detection means.

The generation of the un-dissolved carbonic acid gas can be detected in the carbonate springs led out to the liquid lead-out pipe by including the above configuration. Therefore, in the carbonate springs led out to the liquid lead-out pipe, the anomaly can be monitored by always sampling the bubble amount or by sampling the bubble amount at regular time intervals.

The invention can include the hot water circulating means for circulating the hot water in the bath as the hot water supply means. The bubble detection means can be included in a one-pass type carbonate spring producing system and a circulation type carbonate spring producing system. In the one-pass type carbonate spring producing system, the carbonate springs are produced by passing the hot water through the carbonic acid gas dissolver once. In the circulation type carbonate spring producing system, the hot water in the bath is circulated from a circulating pump through the carbonic acid gas dissolver.

In the bubble detection means including the ultrasonic transmitter, the ultrasonic receiver, and the determination unit, when the carbonic acid gas bubble is contained in the carbonate springs flowing in the liquid lead-out pipe, the ultrasonic wave transmitted from the ultrasonic transmitter is diffused by the bubble, and the attenuated ultrasonic wave is received by the ultrasonic receiver. When the intensity of the ultrasonic wave received by the ultrasonic receiver is lowered below the predetermined threshold, the carbonic acid gas bubbles not lower than a predetermined amount exist in the carbonate springs flowing in the liquid lead-out pipe.

When the determination unit determines that the carbonic acid gas bubbles not lower than the predetermined amount exist in the carbonate springs flowing in the liquid lead-out pipe, namely, when the determination unit detects that the ultrasonic intensity is lowered below the predetermined threshold, the determination unit outputs the abnormal signal.

The determination unit can continuously compare the ultrasonic intensity and the predetermined threshold in the steady state. The ultrasonic intensity is transmitted through the carbonate springs in the liquid lead-out pipe, and the ultrasonic intensity is received by the ultrasonic receiver. Alternatively, the determination unit can compare the ultrasonic intensity received in each sampling time by the ultrasonic receiver to the predetermined threshold in the steady state.

When the comparison value is lowered below the predetermined threshold, the determination unit can determine that the anomaly which obstructs the normal carbonate spring production exists. When the determination unit determines that the anomaly which obstructs the normal carbonate spring production exists, a command of the determination unit is converted into a required signal, and then the signal is outputted to, e.g., a warning display device such as a monitor, a buzzer, and a lamp.

According to the above configuration, in the carbonate springs led out to the liquid lead-out pipe, the bubble amount of un-dissolved carbonic acid gas can be detected based on the ultrasonic reception intensity, which allows the anomaly of the carbonate springs to be detected. Therefore, the anomaly in the gas-liquid separator or the liquid lead-out pipe can be monitored continuously or at regular time intervals for the carbonate springs led out to the liquid lead-out pipe.

In the carbonate springs led out to the liquid lead-out pipe, the bubble amount of un-dissolved carbonic acid gas is monitored by sampling the bubble amount continuously or at regular time intervals from the ultrasonic reception intensity in the liquid lead-out pipe. Therefore, the anomaly can be determined, and the ultrasonic reception intensity can effectively be obtained with stable detection accuracy.

In the invention, it is preferable that the ultrasonic transmitter and the ultrasonic receiver be horizontally arranged. When the ultrasonic transmitter and the ultrasonic receiver are arranged across the liquid lead-out pipe from each other in a vertical direction, because sometimes the bubbles of the un-dissolved carbonic acid gas gather together on the upper side of the liquid lead-out pipe, unfavorably the bubble state cannot correctly be detected in the liquid lead-out pipe. Therefore, it is preferable to horizontally arrange the ultrasonic transmitter and the ultrasonic receiver.

It is preferable that the ultrasonic transmitter and the ultrasonic receiver be arranged across the liquid lead-out pipe 5 from each other. Therefore, detection sensitivity can be improved in the ultrasonic transmitter and the ultrasonic receiver. The malfunction caused by the bubbles accumulated between the ultrasonic transmitter and the ultrasonic receiver can be prevented.

It is also preferable to horizontally arrange the liquid lead-out pipe provided between the ultrasonic transmitter and the ultrasonic receiver. Therefore, the bubble can be stably be detected with high accuracy.

The bubble detection means can include the liquid level sensor. When the carbonate spring containing the un-dissolved carbonic acid gas bubble is introduced to the gas-liquid separator, the un-dissolved carbonic acid gas gathers together in an upper portion of the gas-liquid separator, the carbonate springs in which the un-dissolved carbonic acid gas is removed gathers together in a lower portion, and the un-dissolved carbonic acid gas and the carbonate spring exists in the gas-liquid separator while vertically separated.

The un-dissolved carbonic acid gas emission line can be arranged in the upper portion of the gas-liquid separator, and the un-dissolved carbonic acid gas which gathers together in the upper portion of the gas-liquid separator through the un-dissolved carbonic acid gas emission line can be emitted outside the system. The liquid lead-out pipe can be arranged in the lower portion of the gas-liquid separator. The liquid lead-out pipe leads out the carbonate springs in which the un-dissolved carbonic acid gas is removed.

In the case where blockage is generated in the un-dissolved carbonic acid gas emission line, in the case where the gas-liquid separator does not normally function, or in the case where the amount of un-dissolved carbonic acid gas exceeds the ability to emit the un-dissolved carbonic acid gas from the gas-liquid separator, the gas-liquid separator is filled with the un-dissolved carbonic acid gas.

Therefore, the liquid level of the carbonate springs is lowered in the gas-liquid separator by the un-dissolved carbonic acid gas with which the gas-liquid separator is filled, and the carbonate springs containing the un-dissolved carbonic acid gas bubble flows out to the bath room through the lead-out pipe.

When the liquid level in the gas-liquid separator is lowered below the predetermined threshold, it is determined that the carbonate springs containing the un-dissolved carbonic acid gas bubble flows out to the liquid lead-out pipe, and the abnormal signal can be outputted by the bubble detection means.

In the invention, the bubble detection means including the above configuration can detect the anomaly in which the carbonate springs containing the un-dissolved carbonic acid gas bubble flows out to the bath room through the liquid lead-out pipe. The bubble detection means can be formed by using both the detection with the ultrasonic transmitter and ultrasonic receiver and the detection with the liquid level sensor.

The electromagnetic valve can be included in the carbonic acid gas supply means. The opening and closing of the electromagnetic valve is controlled by the comparison of the predetermined threshold and the ultrasonic intensity received by the ultrasonic receiver. Particularly, the closing of the electromagnetic valve can be controlled by the abnormal signal outputted from the determination unit, and the electromagnetic valve performs the control such that the carbonic acid gas is not supplied to the carbonic acid gas supply means.

The carbonic acid gas supply means can include the flow rate control valve which performs the control to maintain a constant carbonic acid gas flow rate. The hot water supply means can include the liquid sending means which performs the control to maintain a constant flow rate of the hot water supplied to the carbonic acid gas dissolver.

Therefore, the desired relationship can be adjusted between the hot water flow rate and the carbonic acid gas flow rate, and the carbonate springs can efficiently be produced. Particularly the ultrasonic transmission intensity transmitted from the ultrasonic transmitter is influenced by the change in carbonic acid gas flow rate of the carbonic acid gas supply line or the change in hot water flow rate of the hot water supply line (hot water circulating line), so that the these flow rates can be kept constant and the stable detection can be performed by the bubble detection means.

The throttle which increases the water pressure in the gas-liquid separator can be arranged in gas-liquid separator located on the downstream of the gas-liquid separator. The water pressure can be increased in the gas-liquid separator by arranging the throttle. As a result, the liquid level can be held at a higher level in the gas-liquid separator.

In addition, a primary pressure of the un-dissolved carbonic acid gas emission line 16 is raised to allow the increase in flow rate of the un-dissolved carbonic acid gas which is emitted outside the system through the un-dissolved carbonic acid gas emission line. Therefore, the performance of the gas-liquid separator is improved, and the un-dissolved carbonic acid gas can be prevented from flowing out into the bath room.

In the case where the throttle is provided to detect the un-dissolved carbonic acid gas with the ultrasonic wave, desirably the position where the throttle is arranged is located in the liquid lead-out pipe provided on the downstream side of the gas-liquid separator and the position is located on the upstream side of the region where the ultrasonic transmitter and ultrasonic receiver are arranged. The water pressure on the upstream side of the throttle is increased by the effect of the throttle. Although the micro bubbles existing in the carbonate springs are crushed by the increased water pressure, the crushed micro bubbles emerge again by releasing the water pressure after the carbonate spring pass through the throttle. The micro bubbles have sizes which can be detected with the ultrasonic wave. Accordingly, the un-dissolved carbonic acid gas bubbles can be detected with high accuracy by arranging the throttle on the upstream side of the region where the ultrasonic transmitter and ultrasonic receiver are arranged.

A variable throttle can also be used as the throttle. In this case, the voltage or current proportional to the reception intensity of the ultrasonic receiver or liquid level in the gas-liquid separator detected by the liquid level sensor is inputted to a control device such as a controller, and the voltage or current can be outputted as control output computed by the control device. An opening of the variable throttle can be controlled based on a control signal.

When the small amount of un-dissolved carbonic acid gas is emitted from the un-dissolved carbonic acid gas emission line, pressure loss caused by the variable throttle can be suppressed by increasing the opening of the variable throttle. The decrease in flow rate of the hot water discharged from the pump can be suppressed by decreasing the pressure loss by the variable throttle.

When the large amount of un-dissolved carbonic acid gas is emitted from the un-dissolved carbonic acid gas emission line, the pressure loss by the variable throttle can be increased. Therefore, the liquid level in the gas-liquid separator 6 can be raised, and the emission flow rate of the un-dissolved carbonic acid gas from the un-dissolved carbonic acid gas emission line can be increased. As a result, the un-dissolved gas can be prevented from flowing out to the bath room.

Particularly, in the use of the circulation type carbonate spring producing system, the dissolution efficiency of the carbonic acid gas is decreased as the carbonic acid gas concentration of the circulating carbonate springs is gradually increased. However, because the emission amount of un-dissolved carbonic acid gas from the un-dissolved carbonic acid gas emission line can be increased, it is preferable that the opening of the variable throttle be formed so as to be able to be controlled. A fixed throttle whose opening is fixed and the variable throttle whose opening is variable can be used as the throttle of the invention.

In the second aspect of the invention, the flow rate of the carbonic acid gas supplied to the hot water is controlled by supplying the un-dissolved carbonic acid gas generated in the gas-liquid separator to the carbonic acid gas supply line through the compressor arranged in the way of the un-dissolved gas lead-out pipe. In this case, the detection means for measuring the liquid level of the gas-liquid separator is placed instead of the bubble detection means. The liquid level detects the liquid level of the gas-liquid separator, and the un-dissolved carbonic acid gas flow rate is increased by operating the gas flow rate control means when the liquid level of the gas-liquid separator is lower than an opening height of the liquid lead-out pipe by a predetermined height.

Further, the gas flow rate control means measures a rate at which the liquid level of the gas-liquid separator is lowered, the gas flow rate control means computes the carbonic acid gas concentration of the sending hot water, and the gas flow rate control means controls the carbonic acid gas supply flow rates of the carbonic acid gas supply line and un-dissolved gas lead-out pipe. In the case where the concentration setting means for setting the desired carbonic acid gas concentration is included, the gas flow rate control means can control the flow rate of the carbonic acid gas supplied to the carbonic acid gas supply line so as to decrease the flow rate to cause to correspond to the setting value, when the concentration of the sending hot water becomes higher than a value set by the concentration setting means.

When the gas emission pipe is connected to the gas-liquid separator to arrange the emission control valve control valve in the way of the gas emission pipe, the emission control valve can be opened to emit the air which is hardly mixed in the hot water in the gas-liquid separator when the operation of the carbonate spring producing system is started, or the air accumulated in the gas-liquid separator in continuing the long time operation can periodically be emitted. In the event that the redissolution cannot be performed due to the breakdown of the compressor or the redissolved gas control valve, in an emergency procedure, the emission control valve can be opened to emit the un-dissolved carbonic acid gas to the gas emission line so as to prevent the emission of the un-dissolved carbonic acid gas into the bath.

When the carbonic acid gas is supplied, the supply gas control valve is opened while the redissolution control valve is closed, so that the carbonic acid gas redissolving line is closed to apply a load on the compressor. At this point, the compressor might be stopped. However, it is necessary to repeat the startup and stop of the compressor, because the supply and redissolution of the carbonic acid gas are alternately repeated. This causes a mechanical lifetime of the compressor to be shortened. Therefore, bypass piping and a control valve or three-way valve are provided. The control valve or the three-way valve open and close the bypass piping. In supplying the carbonic acid gas, the redissolution control valve is closed to cut off the redissolving line, and the load on the compressor can be eliminated when opening the bypass piping.

Figure 1:
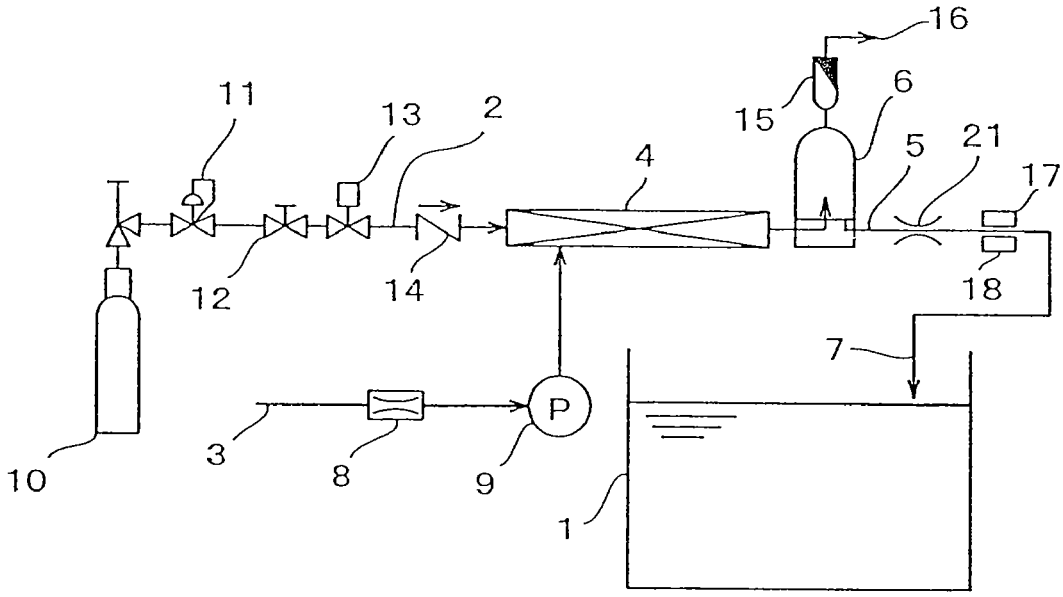
FIG. 1 is an entire explanatory view showing a first embodiment of a one-pass type carbonate spring producing system according to the invention.

| Description of the Reference Numerals and Signs | |
|---|---|
| 1 | bath |
| 2 | carbonic acid gas supply line |
| 3 | hot water supply line (hot water circulating line) |
| 4 | carbonic acid gas dissolver |
| 5 | liquid lead-out pipe |
| 6 | gas-liquid separator |
| 7 | drain line |
| 8 | hot water flow rate control valve |
| 9 | booster pump (circulating pump) |
| 10 | carbonic acid gas bomb |
| 11 | pressure reducing valve |
| 12 | gas flow rate control valve |
| 13 | electromagnetic valve |
| 14 | check valve |
| 15 | air vent valve |
| 16 | un-dissolved gas emission line |
| 17 | ultrasonic transmitter |
| 18 | ultrasonic receiver |
| 19 | prefilter |
| 20 | liquid level sensor |
| 21 | variable throttle |
| 22 | liquid level meter |
| 23 | carbonic acid gas redissolving line |
| 24 | emission control valve |
| 25 | control valve |
| 26 | redissolved gas control valve |
| 27 | compressor |
| 28 | control unit |
| 29 | concentration setting means |
| 30 | control valve |
| 31 | redissolution control valve (three-way valve) |

BEST MODE FOR CARRYING OUT THE INVENTION

Preferred embodiment of the invention will specifically be described below with reference to the accompanying drawings.

FIG. 1 is an entire explanatory view showing an example of a one-pass type carbonate spring producing system according to a first embodiment of the invention.

FIG. 1 shows the one-pass type carbonate spring producing system in which the carbonate springs are produced by passing the hot water through a carbonic acid gas dissolver 4. Referring to FIG. 1, in the one-pass type carbonate spring producing system, a carbonic acid gas supply line 2 and a hot water supply line 3 are connected to the carbonic acid gas dissolver 4. In the carbonate spring producing system, a liquid lead-out pipe 5 is connected on the downstream side of the carbonic acid gas dissolver 4. A gas-liquid separator 6 is arranged in the way of the line of the liquid lead-out pipe 5. A variable throttle 21 and bubble detection means, which are of the feature portion of the invention, are arranged in the liquid lead-out pipe 5 located on the downstream side of the gas-liquid separator 6. A drain line 7 connected to the liquid lead-out pipe 5 is placed while connected to a bath 1.

Although a variable throttle 21 is used in the following description, a fixed throttle may be used instead of the variable throttle. In the case of the use of the fixed throttle, it is desirable that a necessary throttle diameter be previously set in a circuit configuration of the carbonate spring producing system.

The hot water is supplied from a water heater (not shown) through the hot water supply line 3, and a hot water flow rate is adjusted by a hot water flow rate control valve 8. Then, the hot water is increased to predetermined pressure by a booster pump 9, and the hot water is supplied into the carbonic acid gas dissolver 4. On the other hand, the carbonic acid gas is supplied from a carbonic acid gas bomb 10 through the carbonic acid gas supply line 2, and the carbonic acid gas is adjusted at constant pressure by a pressure reducing valve 11. Then, a carbonic acid gas flow rate is adjusted by a gas flow rate control valve 12, and the carbonic acid gas is supplied into the carbonic acid gas dissolver 4 through an electromagnetic valve 13 and a check valve 14. The electromagnetic valve 13 is a shut-off valve of the carbonic acid gas, and the check valve 14 prevents backflow of the carbonic acid gas.

In the carbonic acid gas dissolver 4, the carbonic acid gas is dissolved in the hot water to generate the carbonate springs. The generated carbonate springs are supplied to the gas-liquid separator 6, and a bubble-shape un-dissolved carbonic acid gas contained in the carbonate springs is emitted outside the system from an un-dissolved carbonic acid gas emission line 16 through an air vent valve 15 by the gas-liquid separator 6. On the other hand, the carbonate springs in which the un-dissolved carbonic acid gas is removed are supplied into the bath 1 through the liquid lead-out pipe 5 and the drain line 7.

The un-dissolved carbonic acid gas can be emitted outside the system by extending the un-dissolved carbonic acid gas emission line 16 to the outside of the building and the like where the un-dissolved carbonic acid gas does not harm the human body. For example, cheese piping can be used as the gas-liquid separator 6. In order to improve the separating performance of the gas-liquid separator 6, for example, it is preferable that gravity be utilized to temporarily decrease a carbonate spring feed rate by causing a fluid to flow vertically upward like a fountain. In the case where the piping of the gas-liquid separator 6 is arranged in a crosswise direction, for example, it is desirable that a carbonate spring supply direction be changed with elbow piping or a baffle board. In order to achieve the function, for example, a filter housing can also be diverted.

Although the carbonic acid gas can be dissolved into the hot water in the carbonic acid gas dissolver 4, an unreacted carbonic acid gas is also contained in the carbonate springs. Therefore, even if the gas-liquid separator 6 having the high dissolution efficiency is used, the un-dissolved carbonic acid gas is mixed in the carbonate springs supplied into the bath 1 while formed in the bubble, and the un-dissolved carbonic acid gas is emitted in the bath room. Accordingly, there is a fear that the un-dissolved carbonic acid gas flows out in the bath room, in the case where a large amount of carbonate springs is produced like the carbonate springs used for the full immersion bath.

The un-dissolved carbonic acid gas contained in the carbonate springs can be removed through the un-dissolved carbonic acid gas emission line 16 by providing the gas-liquid separator 6 immediately after the carbonic acid gas dissolver 4, and the un-dissolved carbonic acid gas can be emitted outside the system through the un-dissolved carbonic acid gas emission line 16. Thus, only the carbonate springs which do not contain the un-dissolved carbonic acid gas can be supplied into the bath 1 by providing the gas-liquid separator 6, and the unreacted carbonic acid gas can be controlled so as not to flow out in the bath 1. However, when blockage is generated in the un-dissolved carbonic acid gas emission line 16, or when the gas-liquid separator 6 does not normally function, the un-dissolved carbonic acid gas flows out in the bath room.

Therefore, in the first embodiment, in the carbonate springs led out to the liquid lead-out pipe 5 from the gas-liquid separator 6, the bubble amount of the un-dissolved carbonic acid gas is monitored by always sampling the bubble amount or by sampling the bubble amount at regular time intervals, and opening and closing operations of the carbonic acid gas supply line 2 can be controlled based on increase and decrease of the bubble amount.

The first embodiment has the main feature in which the bubble detection means is provided in the liquid lead-out pipe 5 on the downstream side of the gas-liquid separator 6 or inside the gas-liquid separator 6. Although an ultrasonic sensor is used as the bubble detection means in the first embodiment, the invention is not limited to the ultrasonic sensor. For example, the photosensor and the ultraviolet ray sensor can be used as the bubble detection means. The floating type level sensor, the electrostatic capacity type level sensor, the photosensor type level sensor, the pressure difference type level sensor, and the like can be used as the liquid level sensor in the bubble detection means.

One of modes of the bubble detection means includes an ultrasonic transmitter 17, an ultrasonic receiver 18, and a determination unit (not shown). The ultrasonic transmitter 17 and the ultrasonic receiver 18 are arranged across the liquid lead-out pipe 5 from each other, and the ultrasonic receiver 18 receives an ultrasonic wave transmitted from the ultrasonic transmitter 17.

The ultrasonic transmission intensity and the reception intensity are previously set in the liquid lead-out pipe 5 such that the anomaly of the carbonate springs led out to the liquid lead-out pipe 5 can be detected based on the ultrasonic intensity. The ultrasonic wave having the predetermined transmission intensity, led out from the gas-liquid separator 6, is transmitted from the ultrasonic transmitter 17. The ultrasonic wave is transmitted through the carbonate springs in the liquid lead-out pipe 5, and the ultrasonic intensity received by the ultrasonic receiver 18 can be detected continuously or at regular time intervals.

In the same transmission intensity, the reception intensity of the ultrasonic receiver 18 is decreased as the bubble amount is increased in the liquid lead-out pipe 5. When compared with the new hot water which does not contain the carbonic acid gas, the reception intensity of the ultrasonic receiver 18 is also decreased bypassing the carbonate springs having high concentration through the liquid lead-out pipe 5. When the bubble of the carbonic acid gas is contained in the carbonate springs flowing in the liquid lead-out pipe 5, the ultrasonic wave transmitted from the ultrasonic transmitter 17 is diffused by the bubble, and the attenuated ultrasonic wave is received by the ultrasonic receiver 18. Thus, the reception intensity of the ultrasonic receiver 18 depends on the transmission intensity of the ultrasonic transmitter 17.

The transmission intensity of the ultrasonic transmitter 17 is affected by the change in carbonic acid gas flow rate of the carbonic acid gas supply line 2 or the change in hot water flow rate of the hot water supply line (hot water circulating line) 3. Therefore, it is desirable to control the flow rates constant. It is desirable that a threshold for determining whether or not the anomaly of the carbonate springs is detected be determined by actual measurement so as to be able to be applied to any bath such as synthetic carbonate springs and natural hot water, a water storage tank, a feed water tank, and the like.

When the reception intensity of the ultrasonic receiver 18 is decreased to the ultrasonic intensity which deviated from the predetermined threshold, the abnormal ultrasonic intensity is detected, and a detection signal is outputted to a determination unit (not shown). The determination unit compares the predetermined threshold in the steady state to the ultrasonic intensity received by the ultrasonic receiver 18 through the carbonate springs in the liquid lead-out pipe 5. When the comparison value is lowered below the predetermined threshold, the determination unit can determine that the anomaly which obstructs the normal carbonate spring production exists.

When the determination unit determines that the anomaly which obstructs the normal carbonate spring production exists, the command of the determination unit is converted into the required signal and outputted to the electromagnetic valve 13 arranged in the carbonic acid gas supply line 2, a warning display device (not shown) such as the monitor, the buzzer, and the lamp, and the like. The opening and closing of electromagnetic valve 13 can be controlled by comparing the predetermined threshold and the ultrasonic intensity received by the ultrasonic receiver 18, and the electromagnetic valve 13 can instantaneously be closed so as not to supply the carbonic acid gas.

When the bubble sensor is provided, the determination of the anomaly can be made by continuously monitoring the bubble amount of the un-dissolved carbonic acid gas in the carbonate springs led out to the liquid lead-out pipe 5 from the ultrasonic reception intensity in the liquid lead-out pipe 5 or by monitoring the bubble amount of the un-dissolved carbonic acid gas at regular time intervals, and the ultrasonic reception intensity can effectively be obtained with stable detection accuracy. Thus, the anomaly of the carbonate springs can be detected based on the bubble amount of the un-dissolved carbonic acid gas in the carbonate springs led out to the liquid lead-out pipe 5 using the ultrasonic reception intensity, so that the anomaly can securely be monitored in the carbonate springs led out to the liquid lead-out pipe 5.

The ultrasonic transmitter 17 and the ultrasonic receiver 18 are arranged across the liquid lead-out pipe 5 from each other. Therefore, detection sensitivity can be improved in the ultrasonic transmitter 17 and the ultrasonic receiver 18. The malfunction caused by the bubbles accumulated between the ultrasonic transmitter 17 and the ultrasonic receiver 18 can be prevented.

It is preferable that the ultrasonic transmitter 17 and the ultrasonic receiver 18 be horizontally arranged with respect to the liquid lead-out pipe 5. When the ultrasonic transmitter 17 and the ultrasonic receiver 18 are arranged across the liquid lead-out pipe 5 from each other in a vertical direction, because sometimes the bubbles of the un-dissolved carbonic acid gas gather together on the upper side of the liquid lead-out pipe 5, unfavorably the bubble state cannot correctly be detected in the liquid lead-out pipe 5. It is preferable to horizontally arrange the liquid lead-out pipe 5 provided between the ultrasonic transmitter 17 and the ultrasonic receiver 18.

Figure 2:
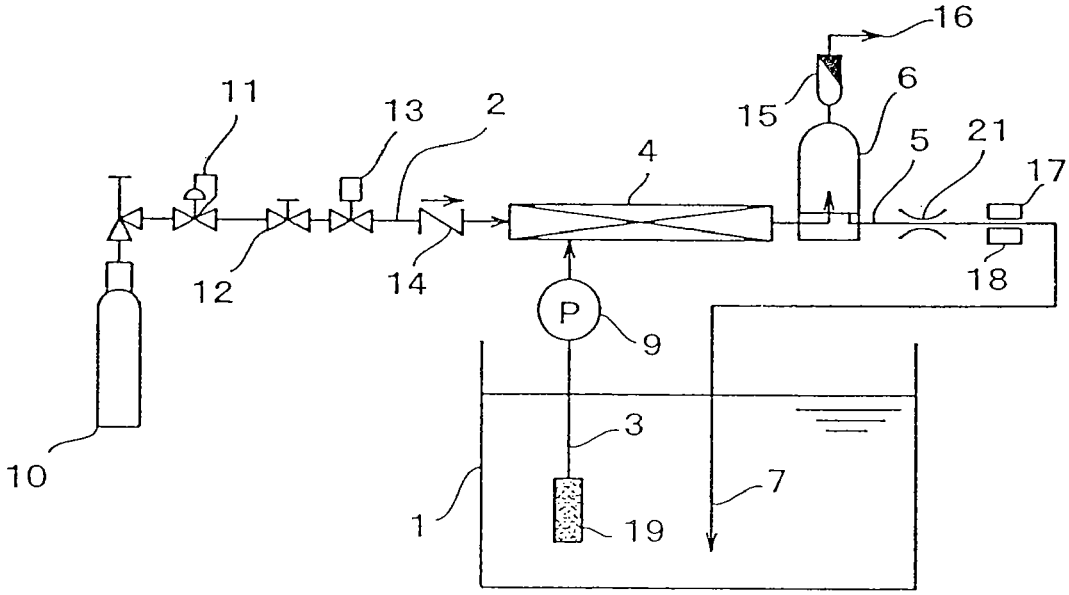
FIG. 2 is an entire explanatory view showing a second embodiment of a circulation type carbonate spring producing system according to the invention.

FIG. 2 is an entire explanatory view showing an example of a circulation type carbonate spring producing system according to a second embodiment of the invention. FIG. 2 shows the circulation type carbonate spring producing system in which the hot water in the bath 1 is circulated from the circulating pump 9 through the carbonic acid gas dissolver 4. In FIG. 2, the substantially same component as the first embodiment is designated by the same component name and the same numeral. Accordingly, the detailed description of the same component will be omitted.

Referring to FIG. 2, the second embodiment differs from the first embodiment in that the circulation type carbonate spring producing system the hot water supply line 3 is formed by a hot water circulating line 3 (water supply line 3) which circulates the hot water in the bath 1. In the circulation type carbonate spring producing system, the hot water in the bath 1 is pumped by a circulating pump 9 through the water supply line 3, the hot water is supplied to the carbonic acid gas dissolver 4 through a prefilter 19, and the hot water is returned to the bath 1 through the drain line 7. On the other hand, similarly to the first embodiment, the carbonic acid gas is supplied to the carbonic acid gas dissolver 4 through the carbonic acid gas bomb 10, the pressure reducing valve 11, the gas flow rate control valve 12, the electromagnetic valve 13, and the check valve 14 while passed through the carbonic acid gas supply line 2.

In the carbonic acid gas dissolver 4, the carbonic acid gas is dissolved in the hot water to generate the carbonate springs. The generated carbonate springs are supplied to the gas-liquid separator 6, and the un-dissolved carbonic acid gas contained in the carbonate springs is emitted outside the system from the un-dissolved carbonic acid gas emission line 16 through the air vent valve 15 by the gas-liquid separator 6. On the other hand, the carbonate springs in which the un-dissolved carbonic acid gas is removed are supplied into the bath 1 through the liquid lead-out pipe 5 and the drain line 7. Thus, the bath 1 is filled with the carbonate spring having the high concentration of the carbonic acid gas by circulating the hot water in the bath 1 for an arbitrary time by the circulating pump 9. The hot water in the bath 1 can be circulated in order to replenish the carbonate springs, in which the carbonic acid gas concentration is decreased in the bath 1, with the new carbonic acid gas.

In the second embodiment, similarly to the first embodiment, in the carbonate springs led out to the liquid lead-out pipe 5, the bubble detection means is provided to monitor the bubble amount of un-dissolved carbonic acid gas by sampling the bubble amount continuously or at regular time intervals from the ultrasonic reception intensity in the liquid lead-out pipe 5, so that the anomaly can securely be monitored.

Figure 3:
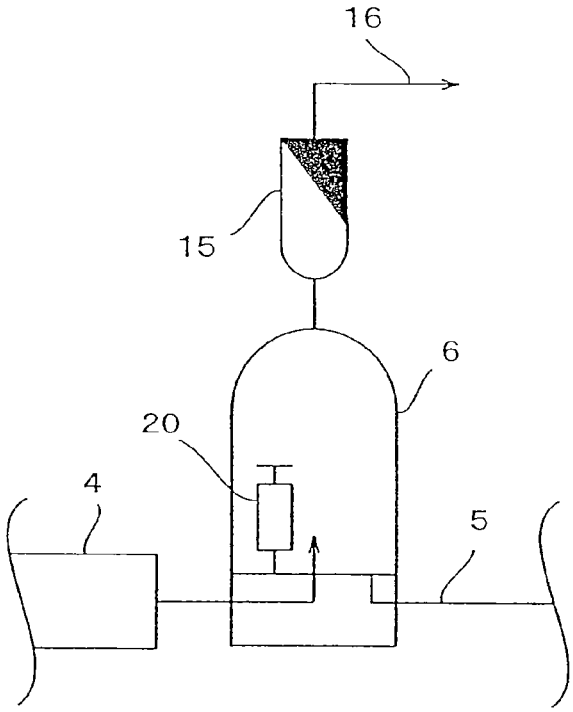
FIG. 3 is an explanatory view showing an example in which a liquid level sensor is arranged in a gas-liquid separator of the carbonate spring producing system.

As shown in FIG. 3, a liquid level sensor 20 can be included in the gas-liquid separator 6 instead of the ultrasonic sensor which is of the bubble detection sensor arranged in the liquid lead-out pipe 5 connected to the gas-liquid separator 6. The floating type, the electrostatic capacity type, the photosensor type, the pressure difference type, and the like can be used as the liquid level sensor 20.

A liquid level sensor which outputs a voltage or a current in proportion to the liquid level can be used as the liquid level sensor 20. However, it is sufficient to detect only whether the liquid level is higher or lower than a predetermined threshold, so that it is more preferable to use the inexpensive floating type liquid level sensor in which a structure is simple and breakdown and malfunction hardly are generated.

When the liquid level sensor detects that the liquid level in the gas-liquid separator 6 is lower than the predetermined threshold, a control device (not shown) to which the detection signal of the liquid level sensor is inputted determines that the carbonate springs containing the bubble of the un-dissolved carbonic acid gas flow out in the liquid lead-out pipe 5, and the control device can output an abnormal signal.

The abnormal signal can also cause the monitor (not shown), the warning display device (not shown) such as the monitor, buzzer, and the lamp to display an alarm or put alarm sound. The electromagnetic valve 13 arranged in the carbonic acid gas supply line 2 can instantaneously be closed to stop the supply of the carbonic acid gas based on the abnormal signal. Therefore, the un-dissolved carbonic acid gas can securely be prevented from flowing out in the bath room.

Both the bubble sensor and the liquid level sensor can be used. That is, a dual detection structure in which the ultrasonic sensor is arranged in the liquid lead-out pipe 5 while the liquid level sensor is arranged in the gas-liquid separator 6 is formed. Therefore, the bubble amount state can be detected in the carbonate springs in a two-stage manner using the bubble sensor and the liquid level sensor, and safety can further be enhanced.

The variable throttle 21 which increases hydraulic pressure in the gas-liquid separator 6 can be included in the liquid lead-out pipe 5 connected onto the downstream side of the gas-liquid separator 6. The hydraulic pressure in the gas-liquid separator 6 can be increased by arranging the variable throttle 21. Therefore, the liquid level can be held at a high position in the gas-liquid separator 6. The increase in hydraulic pressure in the gas-liquid separator 6 enables a primary pressure of the un-dissolved carbonic acid gas emission line 16 to be raised to increase the flow rate of the un-dissolved carbonic acid gas which is passed through the un-dissolved carbonic acid. Therefore, the performance of the gas-liquid separator 6 is improved, the un-dissolved carbonic acid gas can be emitted outside the system, and the un-dissolved carbonic acid gas can be prevented from flowing out in the bath room.

The hydraulic pressure in the gas-liquid separator 6 is affected by the liquid lead-out pipe 5, the drain line 7, and the flow rate of the carbonate springs passed through these flow paths. However, because lengths of the flow paths depend on the situation in which the carbonate spring producing system is placed, it is preferable to arrange the variable throttle 21 in the liquid lead-out pipe 5 in order to adjust the hydraulic pressure in the gas-liquid separator 6 to the desired pressure.

Alternatively, the voltage or current which is proportional to the reception intensity of the ultrasonic receiver 18 or liquid level in the gas-liquid separator 6 detected by the liquid level sensor 20 is inputted to the control device (not shown) such as the controller, and the opening of the variable throttle 21 can be controlled based on the control signal computed by the control device.

When the small amount of un-dissolved carbonic acid gas is emitted from the un-dissolved carbonic acid gas emission line 16, the pressure loss by the variable throttle 21 can be decreased to suppress the decrease in flow rate of the hot water discharged from the pump 9 by increasing the opening of the variable throttle 21.

When the large amount of un-dissolved carbonic acid gas is emitted from the un-dissolved carbonic acid gas emission line 16, the pressure loss by the variable throttle 21 can be increased to raise the hydraulic pressure in the gas-liquid separator 6 by decreasing the opening of the variable throttle 21. The emission flow rate of the un-dissolved carbonic acid gas from the un-dissolved carbonic acid gas emission line 16 can be increased by raising the hydraulic pressure in the gas-liquid separator 6. As a result, the un-dissolved gas can be prevented from flowing out in the bath room.

Particularly, in the circulation type carbonate spring producing system, because the carbonic acid gas concentration is increased in each time when the carbonate springs is circulated, the dissolution efficiency of the carbonic acid gas dissolved in the carbonate springs is decreased. However, because the emission amount of un-dissolved carbonic acid gas from the un-dissolved carbonic acid gas emission line 16 can be increased by controlling the opening of the variable throttle 21, it is preferable that the opening of the variable throttle 21 be controlled based on the detection signal of the bubble detection means.

In the one-pass type and circulation type carbonate spring producing systems, the carbonate springs can be produced without arranging the gas flow rate control valve 12. However, it is preferable to provide the gas flow rate control valve 12 in order to produce the carbonate springs having the accurate carbonic acid gas concentration. Various valve structures such as a needle valve, an electronic type piezoelectric actuator, a solenoid actuator, and an orifice having a throttle can be used as the gas flow rate control valve 12. The type of the gas flow rate control valve 12 is not particularly limited, but desirably the needle valve is used because the needle valve is inexpensive.

The carbonate springs can be produced without arranging the hot water flow rate control valve 8. However, it is preferable to provide the hot water flow rate control valve 8 in order to produce the carbonate springs having the accurate carbonic acid gas concentration. The carbonate springs having the more accurate carbonic acid gas concentration can be produced by using both the hot water flow rate control valve 8 and the gas flow rate control valve 12. The type of the hot water flow rate control valve 8 is not particularly limited. For example, it is preferable to use liquid transport means such as a control valve for fan coil which does not have an influence on the pressure both prior to and subsequent to the valve.

The invention is not particularly limited to the type of the carbonic acid gas dissolver 4, For example, air stone, sintered metal, a membrane module, a static mixer, and a pressurizing spray tank (carbonator) can be used. Particularly it is desirable to use the membrane module and the static mixer. It is desirable to use the membrane module and the static mixer, because the membrane module and the static mixer are so compact that the dissolution efficiency is increased.

In the one-pass type carbonate spring producing system, it is preferable that the booster pump 9 be arranged in the hot water supply line 3. The booster pump 9 can suppress inability to secure the necessary flow rate of the supplied hot water by the influence of the pressure loss of the carbonic acid gas dissolver 4 when the hydraulic pressure is low in the hot water supply line 3.

On the other hand, in the circulation type carbonate spring producing system, the invention is not particularly limited to the type of the circulating pump 9. For example, it is preferable to use a positive displacement metering pump having self-absorbing ability. The stable circulation and a constant circulating water amount can always be secured using the positive displacement metering pump. Because the positive displacement metering pump having self-absorbing ability can be started up without priming in an initial operation, the water can stably be supplied.

The first and second embodiments will further be described based on specific examples along with comparative examples.

EXAMPLE 1

The one-pass type carbonate spring producing system shown in FIG. 1 is used in Example 1. The control is performed such that the electromagnetic valve 13 of the carbonic acid gas supply line 2 opened during the operation of the carbonate spring producing system is cut off when the reception signal received from the ultrasonic receiver 18 becomes not more than the predetermined threshold. In this state of things, the carbonate springs are produced.

The water heater supplies the hot water having the temperature of 40° C. to the carbonic acid gas dissolver 4 at 16 L (liter) per minute, and the carbonic acid gas bomb 10 supplies the carbonic acid gas to the carbonic acid gas dissolver 4 at 12 L (liter) per minute. The maximum value (when the carbonic acid gas is not led out) of the reception signal by the ultrasonic receiver 18 is 7.0 mV, and the predetermined threshold is set at 4.0 my. For a free carbonate concentration in the produced carbonate springs, when the carbonate springs of 200 L are impounded in the bath 1, the carbonic acid gas concentration of the bath water surface is lower than 0.25% in 1000 mg/L, and the carbonic acid gas concentration is not more than the threshold limit value. In this case, the reception signal is 6.0 mV, the ultrasonic intensity received by the ultrasonic receiver 18 exceeds the predetermined threshold, and the electromagnetic valve 13 is in the opened state.

EXAMPLE 2

The carbonate springs are produced on the same conditions as Example 1 except that the un-dissolved carbonic acid gas emission line 16 is closed to disable the ability of the gas-liquid separator 6 to separate the gas and liquid. The reception signal of the ultrasonic receiver 18 immediately becomes 1.0 mV, which is lower than the predetermined threshold, to close the electromagnetic valve 13 of the carbonic acid gas supply line 2. The carbonic acid gas concentration of the bath water surface is lower than 0.25% in the bath 1, and the carbonic acid gas concentration is not more than the threshold limit value.

COMPARATIVE EXAMPLE 1

Similarly to Example 2, the carbonate springs are produced while the ultrasonic transmitter 17 and the ultrasonic receiver 18 are not included. The free carbonate concentration in the produced carbonate springs is 1000 mg/L, the carbonic acid gas concentration of the bath water surface is 1 5% when the carbonate springs of 200 L are impounded in the bath 1, and the carbonic acid gas concentration exceeds the threshold limit value.

EXAMPLE 3

The bubble detection means in which the liquid level sensor 19 is arranged in the gas-liquid separator 6 is used in the circulation type carbonate spring producing system shown in FIG. 2. When the liquid level becomes lower than a predetermined level in the gas-liquid separator 6, the liquid level sensor 19 performs the control so as to cut off the electromagnetic valve 13 of the carbonic acid gas supply line 2 which is opened during the operation of the carbonate spring producing system. In this state of things, the carbonate springs are produced.

The hot water of the bath 1 has the temperature of 40° C., the amount of hot water is 200 L, the circulation flow rate of the pump 9 is set at 13 L (liter) per minute, and the carbonic acid gas bomb 10 supplies the carbonic acid gas to the carbonic acid gas dissolver 4 at 8 L per minute. The static mixer is used as the carbonic acid gas dissolver 4. A height of a space inside the gas-liquid separator 6 is 200 mm, and the liquid level is previously set at 30 mm. After 25 minutes from the start of the operation, the free carbonate concentration in the produced carbonate springs of the bath 1 is 1000 mg/L, the carbonic acid gas concentration of the bath water surface is lower than 0.25%, and the carbonic acid gas concentration is not more than the threshold limit value. The liquid level of the gas-liquid separator 6 exceeds the predetermined liquid level during 25 minutes in operation, and the electromagnetic valve 13 is maintained in the opened state.

EXAMPLE 4

The carbonate springs are produced on the same conditions as Example 3 except that the un-dissolved carbonic acid gas emission line 16 is closed to disable the gas-liquid separating performance of the gas-liquid separator 6. After 10 minutes from the start of the operation, the dissolution efficiency is decreased, the gas-liquid separator 6 is filled with the un-dissolved gas to decrease the liquid level, and the liquid level becomes lower than the predetermined level to close the electromagnetic valve 13 of the carbonic acid gas supply line 2. The carbonic acid gas concentration of the bath water surface is lower than 0.25% in the bath 1, and the carbonic acid gas concentration is not more than the threshold limit value.

COMPARATIVE EXAMPLE 2

Similarly to Example 4, the carbonate springs are produced while the liquid level sensor 19 is not included. After 25 minutes from the start of the operation, the free carbonate concentration in the produced carbonate springs of the bath 1 is 1000 mg/L, the carbonic acid gas concentration of the bath water surface is 1.5%, and the carbonic acid gas concentration exceeds the threshold limit value.

EXAMPLE 5

The carbonate springs are produced on the same conditions as Example 3 except that the production time of the carbonate springs is set at 25 minutes or more. The drain line 7 connected to the downstream side of the gas-liquid separator 6 is a 4 m-length hose having an inner diameter of 19 mm. Because of the circulation type carbonate spring producing system, as time advances, the carbonic acid gas concentration of the circulated carbonate springs is increased while the dissolution efficiency of the carbonic acid gas is decreased. Therefore, the emission amount of un-dissolved gas is increased. After a lapse of the production time of 27 minutes, the liquid level in the gas-liquid separator 6 is decreased, and the liquid level becomes lower than the predetermined level to close the electromagnetic valve 13 of the carbonic acid gas supply line 2. Immediately before the liquid level is decreased, the pressure in the gas-liquid separator 6 is 0.02 MPa, and the emission flow rate of the un-dissolved gas emission line is 5.7 L per minute.

EXAMPLE 6

The carbonate springs are produced on the same conditions as Example 5 except that the variable throttle 21 is arranged in the liquid lead-out pipe 5.

For the throttle state of the variable throttle 21, the inner diameter is set at 8.2 mm, and the length is set at 35 mm. After a lapse of the production time of 41 minutes, the liquid level in the gas-liquid separator 6 is decreased, and the liquid level becomes lower than the predetermined level to close the electromagnetic valve 13 of the carbonic acid gas supply line 2. Immediately before the liquid level is decreased, the pressure in the gas-liquid separator 6 is 0.03 MPa, and the emission flow rate of the un-dissolved gas emission line is 7.1 L per minute.

Then, a third embodiment of the invention will specifically be described with reference to the accompanying drawings.

Figure 4:
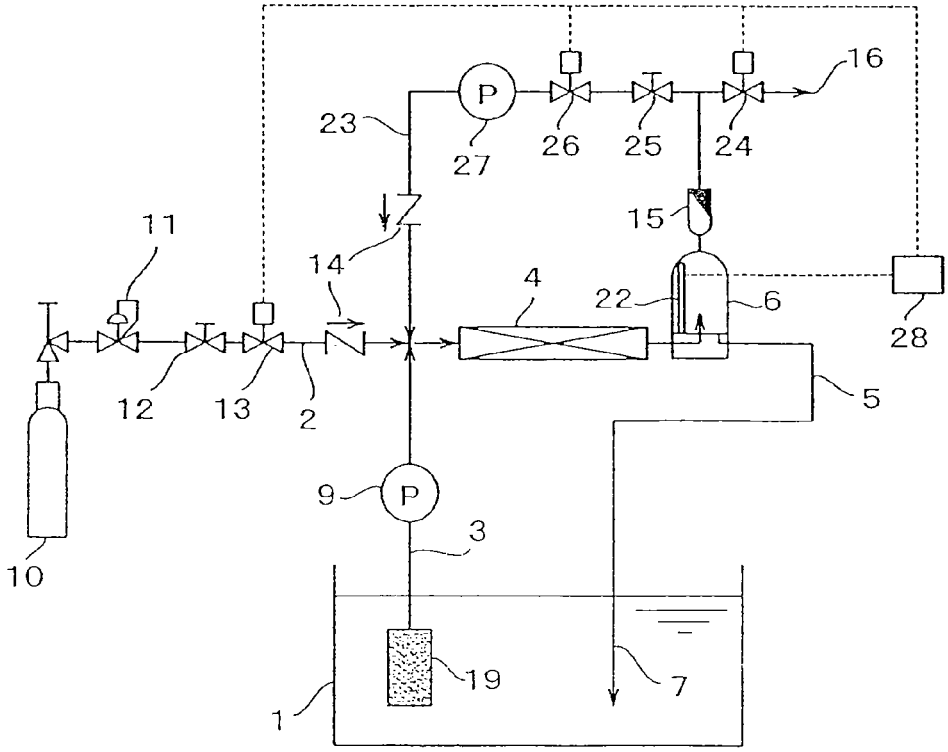
FIG. 4 is an entire explanatory view showing a third embodiment of a circulation type carbonate spring producing system according to the invention.

FIG. 4 is an entire explanatory view showing an example of a circulation type carbonate spring producing system according to the third embodiment. In the third embodiment, the substantially same component as the first and second embodiments is designated by the same component name and the same numeral. Accordingly, the detailed description of the same component will be omitted.

In FIG. 4, one of the features of the circulation type carbonate spring producing system is that the carbonic acid gas supply line 2, the hot water circulating line 3, and the carbonic acid gas redissolving line 23 are connected to the carbonic acid gas dissolver 4. Similarly to the second embodiment, the liquid lead-out pipe 5 is connected onto the downstream side of the carbonic acid gas dissolver 4. The gas-liquid separator 6 is arranged in the way of the line between the liquid lead-out pipe 5 and the carbonic acid gas dissolver 4. A liquid level meter 22 which is of the feature portion of the invention is arranged in the gas-liquid separator 6.

The drain line 7 connected to the liquid lead-out pipe 5 is placed while connected to the bath 1. The hot water is supplied from the bath 1 to the hot water circulating line 3 through a prefilter 19 by the circulating pump 9, and the hot water is supplied into the carbonic acid gas dissolver 4. On the other hand, the carbonic acid gas is supplied from the carbonic acid gas bomb 10 through the carbonic acid gas supply line 2, and the carbonic acid gas is adjusted to a constant pressure by the pressure reducing valve 11. Then, the carbonic acid gas flow rate is adjusted by the gas flow rate control valve 12, and the carbonic acid gas is into the carbonic acid gas dissolver 4 through the supply gas control valve 13 and the check valve 14. The supply gas control valve 13 is a control valve of the supply carbonic acid gas, and the check valve 14 prevents the backflow of the carbonic acid gas.

In the carbonic acid gas dissolver 4, the carbonic acid gas is dissolved in the hot water to generate the carbonate springs. The generated carbonate springs are supplied to the gas-liquid separator 6, and the bubble-shape un-dissolved carbonic acid gas contained in the carbonate springs is led out to the redissolving line 23 through the air vent valve 15 by the gas-liquid separator 6.

A gas flow rate control valve 25, a redissolved gas control valve 26, and a compressor 27 are arranged in the redissolving line 23. The gas flow rate control valve 25, the redissolved gas control valve 26, and the compressor 27 are connected onto the upstream side of the carbonic acid gas dissolver 4. The un-dissolved carbonic acid gas is supplied onto the upstream side of the carbonic acid gas dissolver 4 through the redissolving line 23, the un-dissolved carbonic acid gas is mixed in the hot water, and the un-dissolved carbonic acid gas is dissolved in the hot water again in the carbonic acid gas dissolver 4. On the other hand, the carbonate springs from which the un-dissolved carbonic acid gas is removed is returned to the bath 1 through the liquid lead-out pipe 5 and the drain line 7.

Thus, the bath 1 is filled with the carbonate spring having the high concentration of the carbonic acid gas by circulating the hot water in the bath 1 for an arbitrary time by the circulating pump 9. The hot water in the bath 1 can be circulated in order to replenish the carbonate springs, in which the carbonic acid gas concentration is decreased in the bath 1, with the new carbonic acid gas.

For example, the cheese piping can be used as the gas-liquid separator 6. In order to the improve separating performance of the gas-liquid separator 6, for example, it is preferable that the gravity be utilized to temporarily decrease the carbonate spring feed rate by causing the fluid to flow vertically upward like the fountain. In the case where the piping of the gas-liquid separator 6 is arranged in the crosswise direction, for example, it is desirable that the carbonate spring supply direction be changed with the elbow piping or the baffle board. In order to achieve the function, for example, the filter housing can also be diverted.

A rate at which the un-dissolved carbonic acid gas is accumulated in the gas-liquid separator 6, i.e., the rate at which the liquid level of the gas-liquid separator 6 is lowered is determined by a volume of the gas-liquid separator 6, the hot water flow rate, the flow rate of the carbonic acid gas supplied from the carbonic acid gas bomb 10, and the concentration of the carbonate springs. The volume of the gas-liquid separator 6 is fixed, the hot water flow rate is determined by the ability of the circulating pump 9, and the flow rate of the carbonic acid gas supplied from the carbonic acid gas bomb 10 is kept constant by the gas flow rate control valve 12. Accordingly, the carbonate spring concentration can be computed by measuring the rate at which the un-dissolved carbonic acid gas is accumulated, i.e., a time in which the liquid level of the gas-liquid separator 6 is lowered from the upper limit to the lower limit with a control unit 28. The above method is simple and preferable, because the carbonate spring concentration can be computed with no sensor by utilizing the liquid level meter 22 which is included to control the liquid level of the gas-liquid separator 6. However, the volume of the gas-liquid separator 6, the hot water flow rate, and the flow rate of the carbonic acid gas supplied from the carbonic acid gas bomb 10 depends on specifications of the carbonate spring producing system, so that it is necessary to previously learn a relationship between the carbonic acid gas concentration and the time in which the liquid level of the gas-liquid separator 6 is lowered from the upper limit to the lower limit. Thus, the computation of the carbonate spring concentration enables a display device (not shown) to show that the carbonate spring concentration reaches the desired concentration, the supply of the carbonic acid gas can automatically be stopped when the carbonate spring concentration reaches the desired concentration, or the carbonate spring producing system can be stopped when the carbonate spring concentration reaches the desired concentration.

The bath concentration is decreased by various factors such as bathing and footbath. The concentration is sequentially computed and compared to the desired concentration, and the flow rate of the supplied carbonic acid gas is controlled, which the bath concentration to be kept constant. In the case where the computed concentration is largely lower than the desired concentration, the time in which the bath concentration is increased to the desired concentration can be shortened by increasing the flow rate of the supplied carbonic acid gas. However, when the carbonic acid gas flow rate is changed, the relationship between the concentration and the liquid level lowering rate is changed. Therefore, for example, the carbonic acid gas flow rate is controlled into three stages of a high rate, an intermediate rate, and a low rate, and the relationship between the concentration and the liquid level lowering rate is previously obtained in each stage. In controlling the carbonic acid gas flow rate, the concentration is computed by changing the relationship between the concentration and the liquid level lowering rate.

Figure 5:
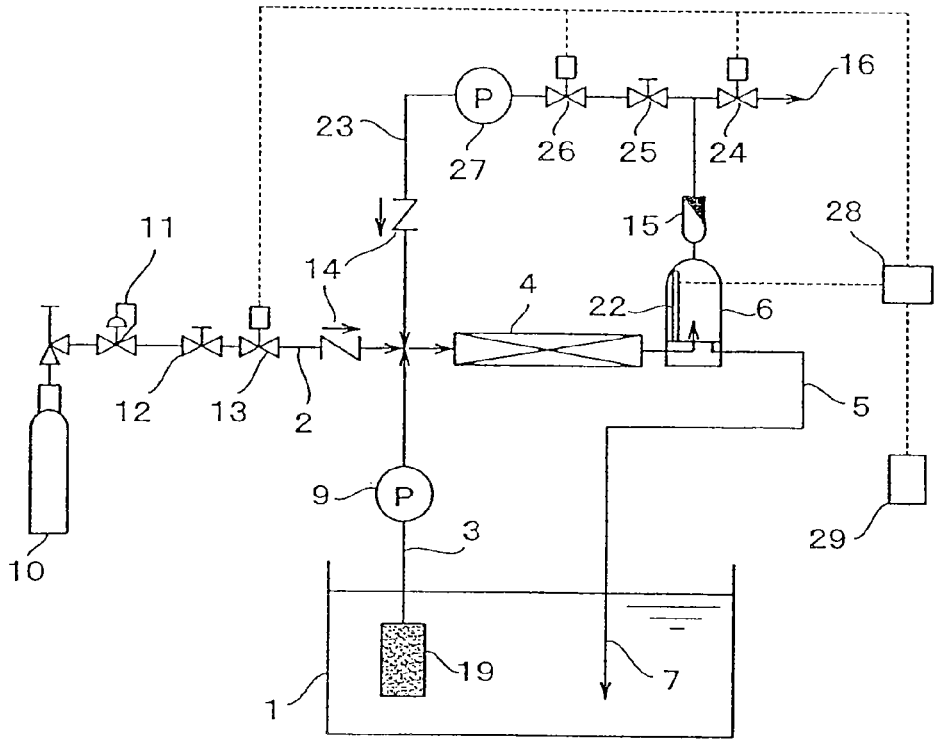
FIG. 5 is an entire explanatory view showing a an example of a carbonate spring producing system including concentration setting means.

As shown in FIG. 5, concentration setting means 29 for previously setting the desired concentration can be included. The hot water flow rate is not determined only by the specifications of the carbonate spring producing system, but sometimes the hot water flow rate is changed by installation situation. For example, the hot water flow rate is decreased by placing the carbonate spring producing system at a position high than the bath, or the hot water flow rate is increased by placing a pump built-in filter on the hot water inlet side of the carbonate spring producing system. The relationship between the concentration and the liquid level lowering rate is changed when the hot water flow rate is changed. However, considerable labor is required to find out the relationship between the concentration and the liquid level lowering rate to change the system specifications in each installation place such that the desired concentration is obtained. Therefore, the concentration setting means 29 is included, and the relationship between the concentration and the liquid level lowering rate is changed to compute the concentration by the setting value of the concentration setting means 29, so that the desired concentration can be obtained by selecting the setting value suitable to the hot water flow rate according to the installation place. Numeric value input with a liquid crystal panel screen, a digital switch, a volume, and the like can be used as the concentration setting means 29.

Figure 7:
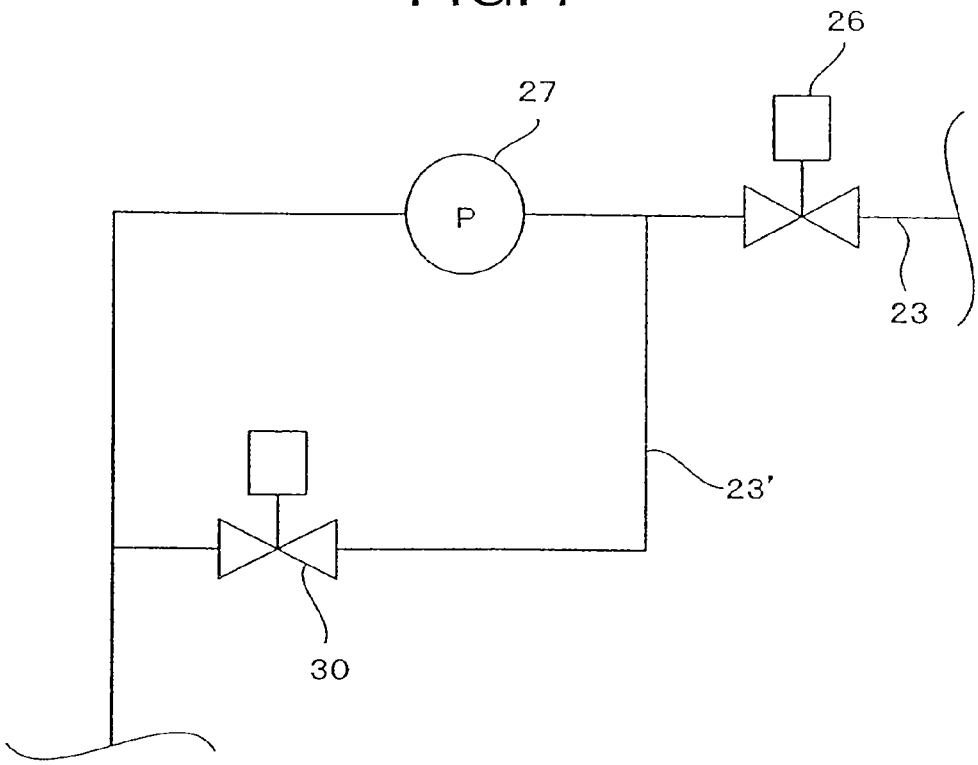
FIG. 7 is a piping diagram showing a first modification of piping in which a discharge side and an inlet side are connected to each other in a compressor.

As shown in FIG. 7, bypass piping 23' and a control valve 30 can be included. The bypass piping 23' connects a discharge side and an inlet side of the compressor 27. The control valve 30 is provided in the way of the bypass piping 23', and the control valve 30 opens and closes the bypass piping 23'. When the carbonic acid gas is supplied, the supply gas control valve 13 is opened while the redissolution control valve 26 is closed, so that the carbonic acid gas redissolving line 23 is choked to apply the load on the compressor 27. At this point, the compressor 27 might be stopped. However, the startup and stop of the compressor 27 are repeated because the supply and redissolution of the carbonic acid gas are alternately repeated. The repetition of the startup and stop in a short-term decreases a mechanical lifetime of the compressor 27. Therefore, the bypass piping 23' and the control valve 30 are provided. The bypass piping 23' connects the discharge side and the inlet side of the compressor 27. The control valve 30 is provided in the way of the bypass piping 23', and the control valve 30 opens and closes the bypass piping 23'. In supplying the carbonic acid gas, it is preferable that the bypass piping 23' which connects the discharge side and the inlet side of the compressor 27 be opened while the redissolution control valve 26 is closed to cut off the redissolving line 23. According to the above mode, the redissolving line 23 is cut off while the compressor 27 is in the operation state, and a circulation passage is formed between the discharge side and the inlet side of the compressor 27. Therefore, the load on the compressor 27 can be eliminated.

Figure 8:
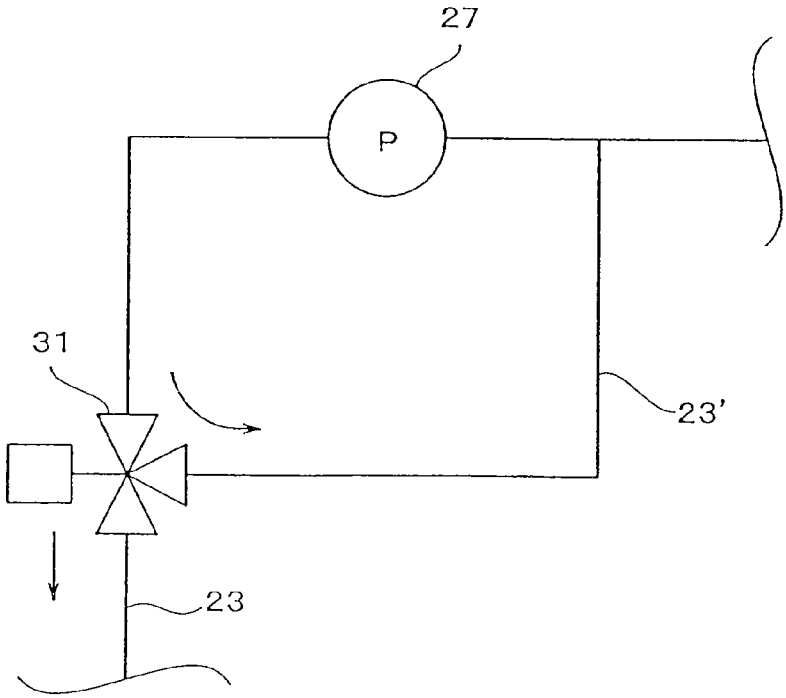
FIG. 8 is a piping diagram showing a second modification of the piping in which the discharge side and the inlet side are connected to each other in the compressor.
Figure 9:
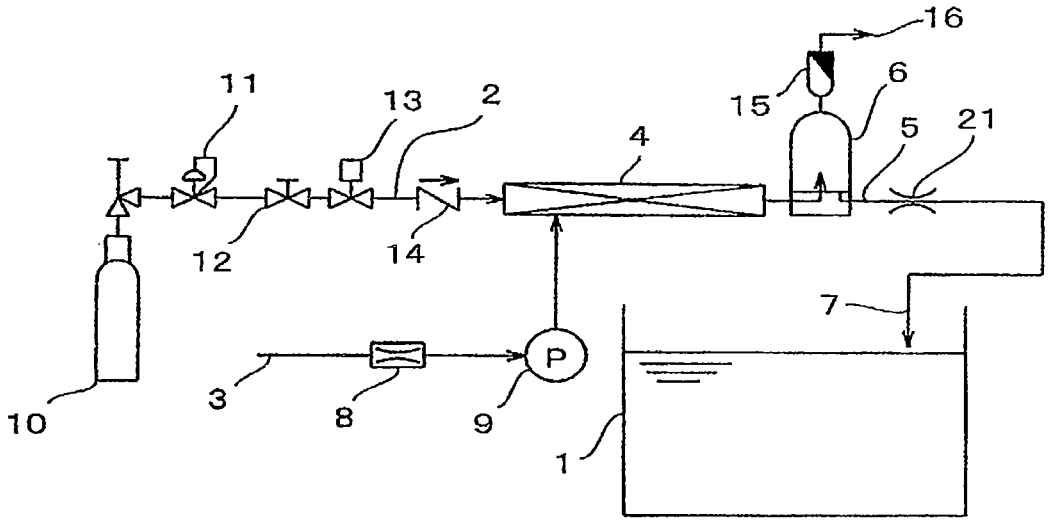
FIG. 9 is an explanatory view of a carbonate spring producing system.
Figure 10:
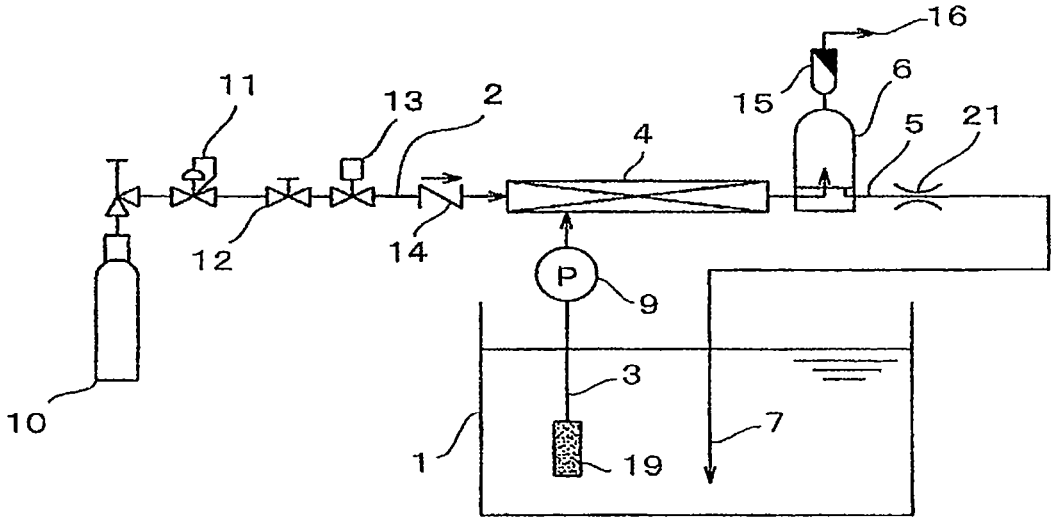
FIG. 10 is an explanatory view of a carbonate spring producing system.

As shown in FIG. 8, it is simple and preferable that a three-way valve 31 be arranged in a merging portion of the bypass piping 23' and the carbonic acid gas redissolving line 23 on the discharge side of the compressor 27 while the control valve 30 which opens and closes the redissolution control valve 26 and the bypass piping 23' be removed, because both the redissolving line 23 and the bypass piping 23' which connects the discharge side and the inlet side of the compressor 27 can simultaneously be opened and closed by the one control valve. The three-way valve 31 may be placed either on the inlet side or the discharge side of the compressor 27. In starting the operation of the carbonate spring producing system, first it is necessary to evacuate air in the gas-liquid separator 6.

According to the above configuration, the un-dissolved carbonic acid gas can be dissolved in the hot water again. However, in the case where the supplied carbonic acid gas has the excessive flow rate, in the case where the supplied hot water has the low saturated concentration due to the high temperature of the supplied hot water, or in the case where the carbonic acid gas concentration of the supplied hot water is gradually increased to the high concentration like the circulation type carbonate spring producing system, the amount of un-dissolved carbonic acid gas emitted from the liquid sent to the gas-liquid separator 6 is increased, and sometimes the amount of un-dissolved carbonic acid gas exceeds the ability to discharge the un-dissolved carbonic acid gas from the gas-liquid separator 6. At this point, the gas-liquid separator 6 is filled with the un-dissolved carbonic acid gas to lower the liquid level of the gas-liquid separator 6. When the liquid level is lowered below a connection port of the liquid lead-out pipe 5 connected to the gas-liquid separator 6, the un-dissolved carbonic acid gas is released from the liquid lead-out pipe 5 of the gas-liquid separator 6.

Therefore, in the third embodiment, the liquid level meter 22 is arranged in the gas-liquid separator 6, and the opening and closing operations of the supply gas control valve 13 and the opening and closing operations of the redissolved gas control valve 26 can be controlled based on the liquid level. The floating type, the electrostatic capacity type, the photosensor type, the pressure difference type, and the like can be used as the liquid level meter 22.

The signal of the liquid level measured by the liquid level meter 22 is transmitted to the control unit 28, and the control unit 28 controls the opening and closing operations of the supply gas control valve 13 and the opening and closing operations of the redissolved gas control valve 26 based on the liquid level. When the liquid level is the upper limit, the supply gas control valve 13 is opened, and the redissolution control valve 26 is closed. At this point, the un-dissolved carbonic acid gas in the carbonic acid gas supplied from the carbonic acid gas supply line 2 is accumulated in the gas-liquid separator 6, and the liquid level is gradually decreased. When the liquid level reaches the lower limit, the supply gas control valve 13 is closed, and the redissolved gas control valve 26 is opened. At this point, the supply of the carbonic acid gas from the carbonic acid gas supply line 2 is cut off, and the un-dissolved carbonic acid gas accumulated in the gas-liquid separator 6 is redissolved to gradually raise the liquid level. Thus, by controlling the flow rate of the carbonic acid gas based on the liquid level of the gas-liquid separator 6, the un-dissolved carbonic acid gas in the hot water can securely be separated and removed by the gas-liquid separator 6, and the separated and removed un-dissolved carbonic acid gas can be redissolved.

Various vales such as the opening adjustable control valve and the electromagnetic valve can be used as the supply gas control valve 13 and the redissolved gas control valve 26. Among others, it is preferable to use the inexpensive electromagnetic valve in which the control is simple and only the opening and closing operations are performed.

The heights of the upper limit and lower limit of the liquid level are not more than the maximum height in the inner space of the gas-liquid separator 6, and the heights of the upper limit and lower limit are in the range not lower than the highest position of the opening in the gas-liquid separator 6 connected to the liquid lead-out pipe 5. The upper limit is higher than the lower limit, and the upper limit and the lower limit can be set at arbitrary heights. However, for the lower limit height of the liquid level, it is preferable that the lower limit be higher than the highest position of the opening of the liquid lead-out pipe 5 such that the bubble of the un-dissolved carbonic acid gas in the hot water does not run around to flow in the liquid lead-out pipe 5. Because the bubble runaround depends on the structure of the gas-liquid separator 6, it is necessary that the height at which the bubble runaround is generated be previously examined to determine the lower limit height of the liquid level. Similarly to the first embodiment, the bubble sensor can separately be placed.

For example, in the case where the filter housing in which the inner diameter is 100 mm and the height of the inner space is 150 mm is used as the gas-liquid separator 6, because the bubble runaround is generated to cause the bubble to flow out to the liquid lead-out pipe 5 when the liquid level is lowered below the position which is higher than the highest position of the opening of the liquid lead-out pipe 5 by 30 mm. Therefore, in the third embodiment, the lower limit of the liquid level is set at 50 mm from the viewpoint of factor of safety.

In starting the operation of the carbonate spring producing system, it is necessary to evacuate the air in the gas-liquid separator 6. Because the air is hardly dissolved in the hot water, the air is separated again in the gas-liquid separator 6 even if the air in the gas-liquid separator 6 is delivered to the redissolving line 23. Therefore, the air is hardly emitted outside the system. It is necessary that the emission control valve 24 be opened to evacuate the air in the gas-liquid separator 6 to the outside of the system by closing the supply gas control valve 13 and redissolved gas control valve 26 only to send the hot water. In the case of the long time operation, sometimes the air bubble is mixed from the flow-in side of the hot water. The air bubble is separated by the gas-liquid separator 6 and accumulated in the gas-liquid separator 6, so that it is preferable that the air be periodically emitted during the operation in addition to the start of the operation. In the event that the redissolution cannot be performed due to the breakdown of the compressor 27 or the redissolved gas control valve 26, in an emergency procedure, the emission control valve 24 can be opened to emit the un-dissolved carbonic acid gas to the gas emission line 16 so as to prevent the emission of the un-dissolved carbonic acid gas into the bath 1.

Figure 6:
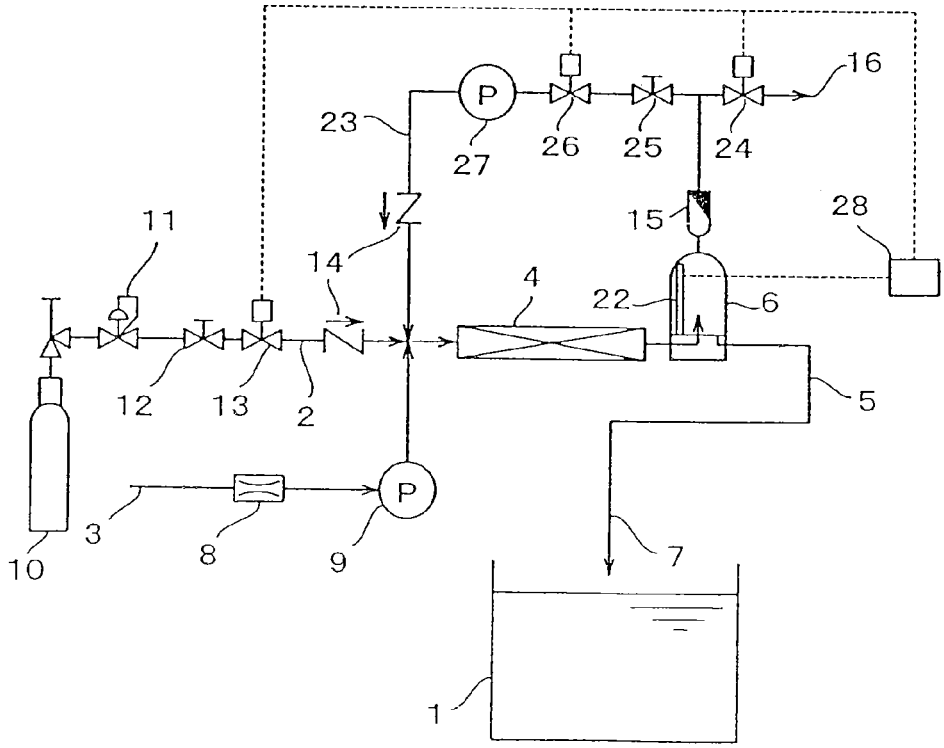
FIG. 6 is an entire explanatory view showing a fourth embodiment of a one-pass type carbonate spring producing system according to the invention.

FIG. 6 is an entire explanatory view showing an example of a one-pass type carbonate spring producing system according to a fourth embodiment of the invention. In the fourth embodiment, the substantially same component as the third embodiment is designated by the same component name and the same numeral. Accordingly, the detailed description of the same component will be omitted. In FIG. 6, the one-pass type carbonate spring producing system of the fourth embodiment differs from the third embodiment in that the hot water circulating line 3 is formed as the water supply line 3. In the fourth embodiment, similarly to the third embodiment, by controlling the flow rate of the carbonic acid gas based on the liquid level of the gas-liquid separator 6, the un-dissolved carbonic acid gas in the hot water can securely be separated and removed by the gas-liquid separator, and the separated and removed un-dissolved carbonic acid gas can be redissolved.

Various valve structures such as a needle valve, an electronic type piezoelectric actuator, a solenoid actuator, and an orifice having a throttle can be used as the gas flow rate control valve 12. The type of the gas flow rate control valve 12 is not particularly limited, but desirably the needle valve is used because the needle valve is inexpensive.

The carbonate springs can be produced even if the hot water flow rate control valve 8 is removed. However, it is preferable to provide the hot water flow rate control valve 8 in order to produce the carbonate springs having the accurate carbonic acid gas concentration. The carbonate springs having the more accurate carbonic acid gas concentration can be produced by using both the hot water flow rate control valve 8 and the gas flow rate control valve 12. The type of the hot water flow rate control valve 8 is not particularly limited. For example, it is preferable to use liquid transport means such as the control valve for fan coil which does not have an influence on the pressure both prior to and subsequent to the valve.

The invention is not particularly limited to the type of the carbonic acid gas dissolver 4. For example, the air stone, the sintered metal, the membrane module, the static mixer, and the pressurizing spray tank (carbonator) can be used. Particularly it is desirable to use the membrane module and the static mixer. It is desirable to use the membrane module and the static mixer, because the membrane module and the static mixer are so compact that the dissolution efficiency is increased.

In the circulation type carbonate spring producing system of the third embodiment, the invention is not particularly limited to the type of the circulating pump 9. For example, it is preferable to use the positive displacement metering pump having self-absorbing ability. The stable circulation and the constant circulating water amount can always be secured using the positive displacement metering pump. Because the positive displacement metering pump having self-absorbing ability can be started up without priming in the initial operation, the water can stably be supplied.

On the other hand, in the one-pass type carbonate spring producing system of the fourth embodiment, it is preferable that the booster pump 9 be arranged in the hot water supply line 3. The booster pump 9 can suppress the inability to secure the necessary flow rate of the supplied hot water by the influence of the pressure loss of the carbonic acid gas dissolver 4 when the hydraulic pressure is low in the hot water supply line 3.

Particularly the third embodiment will further be described based on a specific example along with a comparative example.

EXAMPLE 7

The circulation type carbonate spring producing system shown in FIG. 5 is used in Example 7. Before the carbonate springs are produced, only the hot water is circulated while the supply gas control valve 13 and the redissolved gas control valve 26 are closed, and the emission control valve 24 is opened to emit the air in the system through the gas emission line 16. The control is performed as follows. That is, the emission control valve 24 is closed during the production of the carbonate springs, the supply gas control valve 13 is opened while the redissolved gas control valve 26 is closed when the signal of the liquid level meter 22 in the gas-liquid separator 6 is the upper limit, and the supply gas control valve 13 is closed while the redissolved gas control valve 26 is opened when the signal of the liquid level meter 22 in the gas-liquid separator 6 is the lower limit. The compressor 27 is always operated, and the un-dissolved gas flow rate is controlled by opening and closing the redissolved gas control valve 26. In this state of things, the carbonate springs are produced. The hot water having the temperature of 40□° C. stored in the bath 1 supplied to the carbonic acid gas dissolver 4 at 12 L (liter) per minute, and the carbonic acid gas bomb 10 supplies the carbonic acid gas to the carbonic acid gas dissolver 4 at 8 L (liter) per minute. As time advances, the carbonic acid gas concentration is increased in the carbonate springs, and the emission amount of un-dissolved gas is also increased at the same time. However, even if the carbonic acid gas concentration becomes as high as 1400 mg/L, the liquid level of the gas-liquid separator 6 remains between the set upper limit and lower limit, the bubble of the un-dissolved carbonic acid gas flows out from the liquid lead-out pipe 5, and the un-dissolved carbonic acid gas is never emitted to the bath 1.

Table 1 shows the relationship between the gas concentration of the carbonate springs and the liquid level lowering time in which the liquid level of the gas-liquid separator 6 is lowered from the upper limit to the lower limit. When the carbonic acid gas concentration is increased in the carbonate springs, the emission amount of un-dissolved carbonic acid gas is increased to shorten the liquid level lowering time. There is a correlation between the carbonic acid gas concentration and the liquid level lowering time, and the carbonic acid gas concentration can be computed from the liquid level lowering time. However, the relationship between the carbonic acid gas concentration and the liquid level lowering time depends on the conditions such as the volume of the gas-liquid separator 6, the hot water flow rate, and the flow rate of the carbonic acid gas supplied from the carbonic acid gas bomb 10, so that it is necessary that the correlation is previously determined by performing the examination for the carbonate spring producing system and the carbonate spring producing conditions.

TABLE 1

| Carbonic acid gas concentration of carbonate springs (mg/L) | Liquid level lowering time (second) |
|---|---|
| 200 | 10.0 |
| 400 | 7.7 |
| 600 | 6.8 |
| 800 | 5.6 |
| 1000 | 5.0 |

COMPARATIVE EXAMPLE 3

The carbonate springs are produced on the same conditions as Example 7 except that the liquid level meter 22, the supply gas control valve 13, and the redissolved gas control valve 26 are eliminated. That is, in producing the carbonate springs, the carbonic acid gas is always supplied from the carbonic acid gas bomb 10 at 8 L per minute, and the un-dissolved gas is always redissolved through the carbonic acid gas redissolving line 23. When the production of the carbonate springs is started, the concentration of the carbonate springs is increased with time, and the emission amount of un-dissolved gas is also increased at the same time. At the time when the concentration of the carbonate springs becomes 600 mg/L, the liquid level of the gas-liquid separator 6 is lowered below the lower limit set in Example 7, and the bubble of the un-dissolved carbonic acid gas flows out to the bath 1.

The invention claimed is:

1. A carbonate spring producing system which dissolves a carbonic acid gas in hot water to produce carbonate springs, the carbonate spring producing system characterized by including:

carbonic acid gas supply means;

a control valve which controls a flow rate of the carbonic acid gas;

hot water supply means;

a carbonic acid gas dissolver which is connected to the carbonic acid gas supply means and connected to the hot water supply means;

a gas-liquid separator which is connected on a downstream side of the carbonic acid gas dissolver;

an un-dissolved carbonic acid gas lead-out pipe which is connected on an upstream side of the carbonic acid gas dissolver while connected to the gas-liquid separator;

a liquid lead-out pipe which is connected to the gas-liquid separator;

detection means for measuring a liquid level of the gas-liquid separator, flow rate control means for controlling the flow rate of the supplied carbonic acid gas and the flow rate of the un-dissolved carbonic acid gas based on the liquid level of the gas-liquid separator; and gas flow rate control means for measuring a rate at which the liquid level is lowered in the gas-liquid separator with a device, the gas flow rate control means computing a carbonic acid gas concentration in the hot water to control the flow rate of the supplied carbonic acid gas.

2. A carbonate spring producing system according to claim 1, characterized in that the flow rate control means includes control to raise the liquid level of the gas-liquid separator higher than the liquid lead-out pipe of the gas-liquid separator.

3. A carbonate spring producing system according to claim 1, characterized by including:

a gas emission pipe which is connected to the gas-liquid separator; and an emission control valve which is arranged in a way of the gas emission pipe.

4. A carbonate spring producing system according to claim 1, characterized by including:

a compressor;

piping which connects a discharge side and an inlet side of the compressor; and a control valve which is arranged in the way of the piping, the control valve opening and closing the piping.

5. A carbonate spring producing system according to claim 1, characterized by further including:

concentration setting means for setting the desired carbonic acid gas concentration; and gas flow rate control means for controlling the flow rate of the supplied carbonic acid gas such that the concentration in the hot water becomes equal to a value set by the concentration setting means.

6. A carbonate spring producing system according to claim 1, characterized in that the hot water supply means has hot water circulating means for circulating the hot water in a bath.

7. A carbonate spring producing system according to claim 2, characterized by including:

a gas emission pipe which is connected to the gas-liquid separator; and an emission control valve which is arranged in a way of the gas emission pipe.

8. A carbonate spring producing system according to claim 2, characterized by including:

a compressor;

piping which connects a discharge side and an inlet side of the compressor; and a control valve which is arranged in the way of the piping, the control valve opening and closing the piping.

9. A carbonate spring producing system according to claim 2, by including:

a liquid level sensor arranged inside the gas-liquid separator, and when a liquid level in the gas-liquid separator is lower than a predetermined threshold, a determination unit to which a detection signal from the detection means is input determines that the anomaly exists in the liquid lead-out pipe, and the determination unit outputs the abnormal signal.

10. A carbonate spring producing system according to claim 2, characterized in that a throttle which increases water pressure in the gas-liquid separator is arranged in the liquid lead-out pipe.

11. A carbonate spring producing system according to claim 1, wherein said system further includes a control valve which controls a flow rate of un-dissolved carbonic acid gas from the gas-liquid separator; and a compressor which is arranged in a way of the un-dissolved carbonic acid gas lead-out pipe.

* * * * *